US007313334B2

(12) United States Patent
Inukai

(10) Patent No.: US 7,313,334 B2
(45) Date of Patent: Dec. 25, 2007

(54) IMAGE FORMATION DEVICE ENABLING SWITCHING BETWEEN COLOR PRINTING MODE AND MONOCHROME PRINTING MODE

(75) Inventor: Hideaki Inukai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 209 days.

(21) Appl. No.: 11/024,983

(22) Filed: Dec. 30, 2004

(65) Prior Publication Data

US 2005/0163515 A1 Jul. 28, 2005

(30) Foreign Application Priority Data

Jan. 5, 2004 (JP) ..... 2004-000215

(51) Int. Cl.
*G03G 15/00* (2006.01)
*G03G 15/01* (2006.01)

(52) U.S. Cl. ..... 399/12; 399/13; 399/28

(58) Field of Classification Search ..... 399/12
See application file for complete search history.

(56) References Cited

U.S. PATENT DOCUMENTS 5,294,969 A 3/1994 Ito
5,471,292 A 11/1995 Okazawa
6,029,018 A * 2/2000 Rogers et al. ..... 399/12
6,453,129 B1 * 9/2002 Simpson et al. ..... 399/23
6,658,219 B1 * 12/2003 Ito et al. ..... 399/27
7,031,623 B2 * 4/2006 Haramoto ..... 399/12
7,065,304 B2 * 6/2006 Taguchi ..... 399/12
7,236,725 B2 * 6/2007 Inukai et al. ..... 399/223
2003/0165347 A1 9/2003 Sawano
2005/0123308 A1 * 6/2005 Taguchi ..... 399/12

FOREIGN PATENT DOCUMENTS

JP 2002-204360 7/2002
JP 2002-351190 A 12/2002
JP 2003-43773 A 2/2003
JP 2003-316106 * 6/2003
JP 2003-208064 7/2003
JP 2003-316106 A 11/2003
JP 2004361674 A 12/2004

* cited by examiner

*Primary Examiner*—Anjan Deb
*Assistant Examiner*—Jeff Natalini
(74) *Attorney, Agent, or Firm*—Sughrue Mion PLLC

(57) ABSTRACT

An image formation device has an image carrier in which is formed a latent image and a development device in which are detachably mounted a plurality of development units housing a developing agent. When development units of a plurality of colors, used to form color images are mounted in respectively predetermined mounting positions of the development device, operation is in color printing mode; and, a development unit of a single color among the development units of the plurality of colors is mountable in any mounting position of the plurality of mounting positions, and when the development unit of a single color is mounted in any of the positions of the plurality of mounting positions, operation is in monochrome printing mode.

11 Claims, 15 Drawing Sheets

| CASE | COLOR INFORMATION AT MOUNTING POSITIONS | | | | PRINTING MODE |
|---|---|---|---|---|---|
| | BLACK | MAGENTA | CYAN | YELLOW | |
| A | – | – | – | – | ERROR |
| B | – | – | – | K | K MONOCHROME PRINTING MODE |
| C | – | – | K | – | |
| D | – | – | K | K | |
| E | – | K | – | – | |
| F | – | K | – | K | |
| G | – | K | K | – | |
| H | – | K | K | K | |
| I | K | – | – | – | |
| J | K | – | – | K | |
| K | K | – | K | – | |
| L | K | – | K | K | |
| M | K | K | – | – | |
| N | K | K | – | K | |
| P | K | K | K | – | |
| Q | K | K | K | K | |
| R | K | M | C | Y | COLOR PRINTING MODE |

FIG. 9

| CASE | COLOR INFORMATION AT MOUNTING POSITIONS | | | | PRINTING MODE |
|---|---|---|---|---|---|
| | BLACK | MAGENTA | CYAN | YELLOW | |
| A | — | — | — | — | ERROR |
| B | — | — | — | K | K MONOCHROME PRINTING MODE |
| C | — | — | K | — | |
| D | — | — | K | K | |
| E | — | K | — | — | |
| F | — | K | — | K | |
| G | — | K | K | — | |
| H | — | K | K | K | |
| I | K | — | — | — | |
| J | K | — | — | K | |
| K | K | — | K | — | |
| L | K | — | K | K | |
| M | K | K | — | — | |
| N | K | K | — | K | |
| P | K | K | K | — | |
| Q | K | K | K | K | |
| R | K | M | C | Y | COLOR PRINTING MODE |

IMAGE FORMATION DEVICE ENABLING SWITCHING BETWEEN COLOR PRINTING MODE AND MONOCHROME PRINTING MODE

BACKGROUND OF THE INVENTION

1. Field of the Invention

This invention relates to a color printer, fax machine, photocopier, or other image formation device which forms images using electrophotographic technology, and in particular relates to an image formation device enabling switching between a color printing mode and a monochrome printing mode, and which moreover affords increased flexibility in mounting a developing unit in the monochrome printing mode.

2. Description of the Related Art

Image formation devices which form images using electrophotographic technology, provided for example in color printers, have an image carrier in which is formed an electrostatic latent image according to image data; a charging unit which charges the outer surface of the image carrier; an exposure unit which exposes the outer surface of the charged image carrier according to image data, to form an electrostatic latent image; a developer device which supplies toner, as a developing agent, to the electrostatic latent image to develop a toner image; and a transfer unit which causes the toner image to be transferred to a media. The developer device detachably holds a plurality of developing units which house color toners, and has a developer unit holder which causes the appropriate developer unit to be brought into proximity with the image carrier according to the development timing. This developer unit holder is normally a rotatably controlled developing rotary. When performing color printing, development units with color toner in a plurality of colors, for example, four colors (yellow or Y, magenta or M, cyan or C, and black or K) is mounted in the developing rotary. When performing monochrome printing using only black toner, a black development unit is mounted in the developing rotary.

An image formation device has been proposed which can be put into a color printing mode in which a four-color development unit is mounted, or into a monochrome printing mode in which only a black development unit is mounted, with the user able to switch between the two modes as appropriate. Such an image formation device has been proposed in, for example, Japanese Patent Laid-open No. 2003-43773 (Publication Date: Feb. 14, 2003), Japanese Patent Laid-open No. 2003-316106 (Publication Date: Nov. 6, 2003), and Japanese Patent Application No. 2003-160059.

In Japanese Patent Laid-open No. 2003-43773 and Japanese Patent Application No. 2003-160059, an image formation device is disclosed in which the color printing mode is set when four color development units are mounted in the developing rotary, and the monochrome printing mode is set when a single black development unit is mounted only in the mounting position for the black development unit of the developing rotary, with no development units mounted in the other mounting positions, which are CMY positions.

In Japanese Patent Laid-open No. 2003-316106, an image formation device is disclosed in which the mounting positions in the developing rotary are not in fixed one-to-one correspondence with development units in four colors, and a development unit of an arbitrary color can be mounted in an arbitrary mounting position. In this image formation device, information on the color of the developing agent is read from memory provided in the development unit, to detect which color development units are mounted in which positions of the developing rotary, and based on the detected positions, rotation of the developing rotary is controlled in the development process. Specifically, in Japanese Patent Laid-open No. 2003-316106, when development units in the four CMYK colors are mounted, the device operates as a color printer, and when only the black development unit is mounted, the device operates as a black monochrome printer.

Further, an image formation device has been proposed in which, by mounting black development units in all four of the mounting positions of the developing rotary and setting the monochrome printing mode, the number of times development units need to be replaced can be reduced. Such an image formation device is disclosed in Japanese Patent Laid-open No. 2002-351190 (Publication Date: Dec. 4, 2002). In this image formation device, by mounting four black development units in the four mounting positions of the developing rotary for color printing, reading memory provided in the development units, detecting the mounting positions, color information, and amount of toner remaining, and by using the black development units in order, the frequency of replacement of development units in monochrome printing mode can be reduced, even for small-type development devices.

SUMMARY OF THE INVENTION

In the image formation devices disclosed in each of Japanese Patent Laid-open No. 2003-43773, Japanese Patent Laid-open No. 2003-316106, and Japanese Patent Application No. 2003-160059, switching between color printing mode and monochrome printing mode is possible; but in all cases, it is not possible to improve the flexibility of mounting and replacing development units for monochrome printing, while optimally maintaining the image quality and printing speed of color printing.

For example, the image formation devices of Japanese Patent Laid-open No. 2003-43773 and Japanese Patent Application No. 2003-160059 operate in color printing mode when four-color (CMYK) development units are mounted in the developing rotary, and operate in monochrome printing mode when only one black development unit is mounted in the black position of the developing rotary. Hence in order to set the monochrome printing mode, the black development unit must be mounted only in the black position, and mounting of the black development unit in other positions is not allowed; hence there is the problem that there is no flexibility or freedom in the development unit mounting position, detracting from user convenience.

On the other hand, since the image formation device of Japanese Patent Laid-open No. 2003-316106 allows mounting of development units in four colors (CMYK) in arbitrary positions in the color printing mode, therefore the image quality and printing speed cannot be optimized. For example, when high image quality can be ensured by performing development in CMYK order considering toner overlap printing, if the development units are mounted in the developing rotary in CYKM order, then in the printing process the developing rotary must be rotated back and forth, so that printing speed is worsened compared with the case of rotation in order. Conversely, if the printing process is executed in the CYKM order of the mounted development units, with emphasis placed on printing speed, then image quality may suffer compared with the case in which the toner overlap printing order is optimal.

Moreover, in Japanese Patent Laid-open No. 2003-43773, Japanese Patent Laid-open No. 2003-316106, Japanese Patent Application No. 2003-160059 and Japanese Patent Laid-open No. 2002-351190, there is no description of a method of displaying to the user the amount of toner remaining in monochrome printing. As the freedom of mounting of development units for monochrome printing is raised, it is important, in the interest of user convenience, that the amount of toner remaining in the mounted development units be displayed to the user.

Hence an object of this invention is to provide an image formation device which enables improved flexibility of mounting and replacement of development units for monochrome printing, while maintaining optimal color printing image quality and printing speed.

A further object of this invention is to provide an image formation device which enables display of the amount of toner remaining, in order to improve convenience to users.

In order to attain the above objects, in a first perspective of the invention, an image formation device, comprising an image carrier in which is formed a latent image and a development device in which are detachably mounted a plurality of development units housing a developing agent, is characterized in that:

when development units of a plurality of colors, used to form color images are mounted in respectively predetermined mounting positions of the development device, operation is in color printing mode; and, a development unit of a single color among the development units of the plurality of colors is mountable in any mounting position of the plurality of mounting positions, and when the development unit of a single color is mounted in any of the positions of the plurality of mounting positions, operation is in monochrome printing mode.

In a preferred embodiment of the first perspective, the plurality of mounting positions of the development device receive mounting of the respective corresponding development units in a plurality of colors via respectively different engaging structure, and the single-color development unit has an engaging structure enabling mounting in any of the plurality of mounting positions.

In order to attain the above objects, in a second perspective of the invention, an image formation device, having an image carrier in which is formed a latent image and a development device in which are detachably mounted a plurality of development units housing a developing agent, is characterized in that:

a plurality of color development units used to form color images are mountable in respectively predetermined mounting positions of the development device, and when the development units in a plurality of colors are mounted in the reserved mounting positions, operation is in color printing mode;

a development unit of a single color among the development units of a plurality of colors is mountable in any mounting position of the plurality of mounting positions, and when the development unit of a single color is mounted in any of the positions of the plurality of mounting positions, operation is in monochrome printing mode; and, the development units have storage element for storing color information and remaining amount information for the developing agent housed therein; and further having display unit for displaying, according to the color information and remaining amount information stored in the storage element of development units mounted in the development device, information as to whether the development units are mounted and remaining amount information for development agents of mounted development units in corresponding to the plurality of mounting positions.

According to the first perspective, in color printing mode the development units of a plurality of colors for color printing are mounted in the respective reserved positions determined in advance, so that development processing can be performed in the optimum order, enabling high image quality and high printing speed, whereas in monochrome printing mode, a single-color development unit for monochrome printing can be mounted in any of the mounting positions of the development device, so as to increase flexibility when replacing development units, and improve user convenience.

According to the second perspective, because a development unit in monochrome printing mode can be mounted in an arbitrary position and in arbitrary number, whether a development unit is mounted in a corresponding mounting position, and the amount of developing agent remaining are displayed, so that the task of replacing monochrome development units can be made easy.

BRIEF DESCRIPTION OF THE DRAWINGS

FIG. 9 shows a judgment table for printing mode judgment;

DESCRIPTION OF THE PREFERRED EMBODIMENTS

Figure 1:
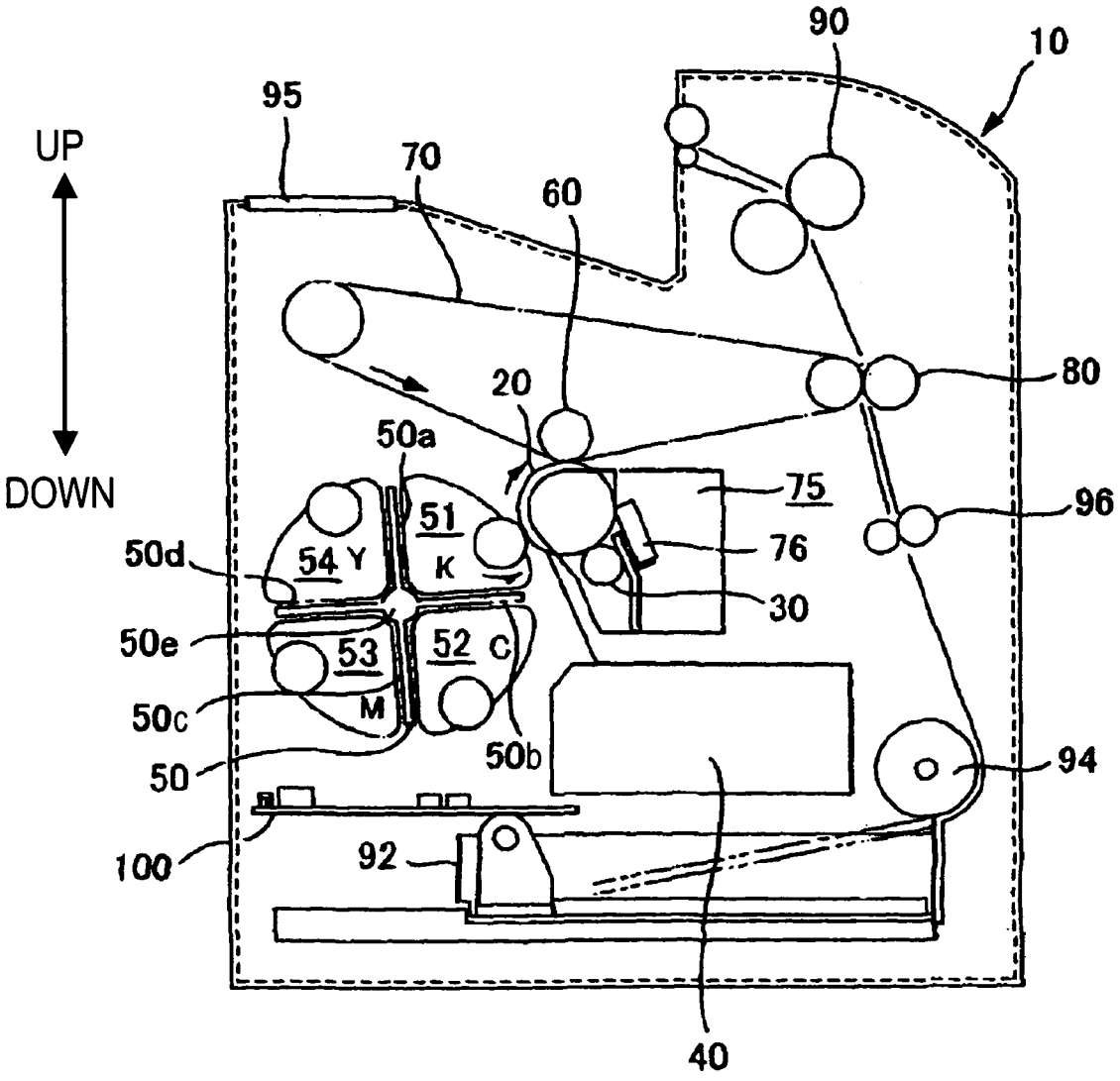
FIG. 1 shows the principal configuration of the image formation device of the embodiment, when in color printing mode.

Below, the embodiments of the invention are explained referring to the drawings. However, the technical scope of the invention is not limited to these aspects, but extends to the inventions described in the scope of claims and to inventions equivalent thereto.

FIG. 1 shows the principal configuration of the image formation device of the embodiment. This embodiment is explained taking a laser beam printer 10 as an example of an image formation device. The printer 10 in FIG. 1 is shown in a configuration for the color printing mode.

The printer 10 has, in order in the direction of rotation of the photosensitive drum 20 which is the image carrier carrying latent images, a charging unit 30; an exposure unit 40; a developer 50; a primary transfer unit 60; an intermediate transfer member 70; and a cleaning unit 75. The printer 10 further has a secondary transfer unit 80; a fixing unit 90; a display unit 95 which displays various information to the user; and a control unit 100 which controls these units. The control unit 100 differs from FIG. 1 in being mounted in the vertical direction with respect to the printer 10.

The photosensitive drum 20 has a cylindrical conductive base and a photosensitive layer formed on the outer surface thereof, is rotatable about the center axis, and rotates in the clockwise direction, as indicated by an arrow. The charging unit 30 charges the photosensitive drum 20, and the exposure unit 40 irradiates the charged photosensitive drum 20 with a beam from an internal laser, LED array, or other light source, to form a latent image due to static charge on the photosensitive drum 20. The beam irradiation by the exposure unit 40 is controlled by a driving signal, modulated based on image information input from a host computer.

The development device 50 has mounting portions 50*a* through 50*d*, into which development units 51 through 54 housing the toner as the developing agent can be detachably mounted, and is a developing rotary, rotatable about the central axis 50*e*. By causing the development device 50 to rotate, bringing the necessary development units 51 through 54 into proximity with the photosensitive drum 20, and supplying the developing agent to the photosensitive drum 20 on which a latent image is formed, the latent image is developed into an image by the developing agent. In the example of FIG. 1, development units 51 through 54, housing developing agents in the colors black (K), cyan (C), magenta (M), and yellow (Y), are respectively mounted in the mounting portions 50*a* through 50*d* of the development device 50, so the printer is put into color printing mode, and in the printing process, the latent image formation on the photosensitive drum 20 and development using the respective developing agents are performed, in the order CMYK. Hence upon each process of latent image formation and development for each color, the development device 50 rotates in the clockwise direction, bringing the development unit of the appropriate color into proximity with the photosensitive drum 20, to perform development in order.

The primary transfer unit 60 transfers the toner image formed on the photosensitive drum 20 to the intermediate transfer member 70. The intermediate transfer member 70 is an endless belt, comprising for example PET film on the surface of which an aluminum evaporation-deposited layer is formed, on the surface of which a semiconducting material is applied, and is driven in rotation at the same angular velocity as the photosensitive drum 20. In color printing mode, images in the CMYK colors are transferred, overlapping, onto the intermediate transfer member 70; in monochrome printing mode, an image in a single color is transferred onto the intermediate transfer member 70. The secondary transfer unit 80 then transfers the toner image formed on the intermediate transfer member 70 to paper or some other printing media, the fixing unit 90 fixes the toner image, transferred onto the printing media, to create a permanent image on the media, and the printing media is then ejected from the printer.

The cleaning unit 75 is provided between the primary transfer unit 60 and the charging unit 30, and has a cleaning blade 76 which is held in contact with the surface of the photosensitive drum 20; after primary transfer, the remaining developing agent (toner) on the photosensitive drum 20 is removed by the cleaning blade 76.

Each of the development units 51 through 54 can be mounted onto and detached from the development device 50, and is provided with storage element, such as for example non-contact and non-volatile memory, which stores color information and remaining amount information for the developing agent. When power is turned on or after a development unit is newly mounted in the development device, the information in the non-volatile memory of the development unit is read. Also, after development, the developing agent remaining amount information in the non-volatile memory of the development unit is updated.

When the CMYK development units 51 through 54 are mounted in their respective predetermined positions in the development device 50, the mounted states are identified by reading information in the above-described non-volatile memory, and the printer 10 operates in color printing mode. In color printing mode, print job data described in a language used for color printing is supplied by the host computer, and formation of electrostatic latent images on the photosensitive drum 20, development by the development unit of the corresponding color, and transfer of the toner image onto the intermediate transfer member 70 by the primary transfer unit 60, are repeated in CMYK order. After the CMYK toner images have been transferred to the intermediate transfer member 70, the color image on the intermediate transfer member 70 is transferred to the paper or other printing media by the secondary transfer unit 80 and is fixed by the fixing unit 90, and the printing media is ejected from the printer.

Even when the CMYK development units are mounted as shown in FIG. 1, if print job data indicating monochrome printing is supplied by the host computer, development is performed by, for example, the black development unit when black monochrome printing is specified, and the monochrome image is formed on the printing media.

Figure 2:
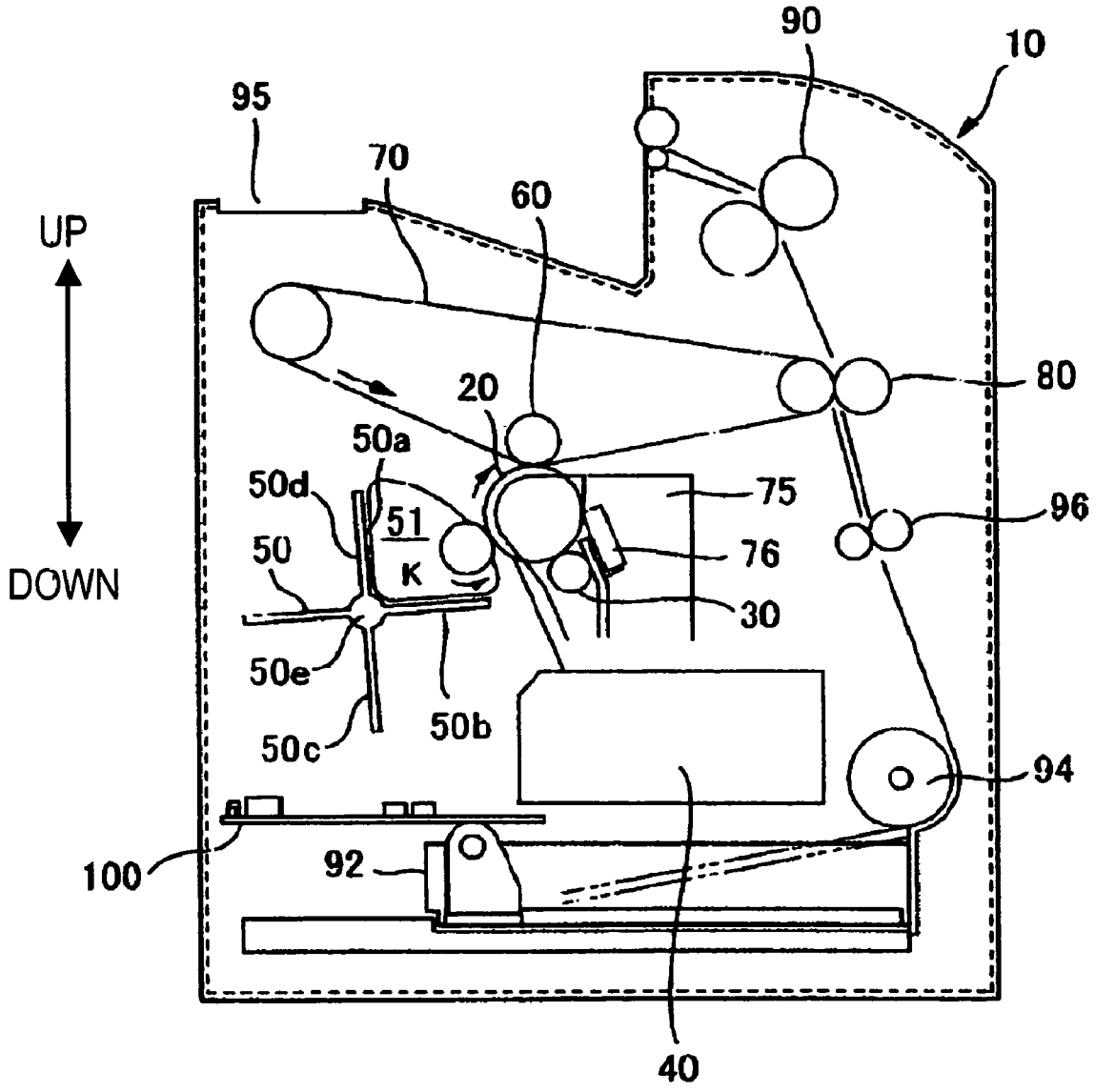
FIG. 2 shows the principal configuration of the image formation device of the embodiment, when in monochrome printing mode.
Figure 3:
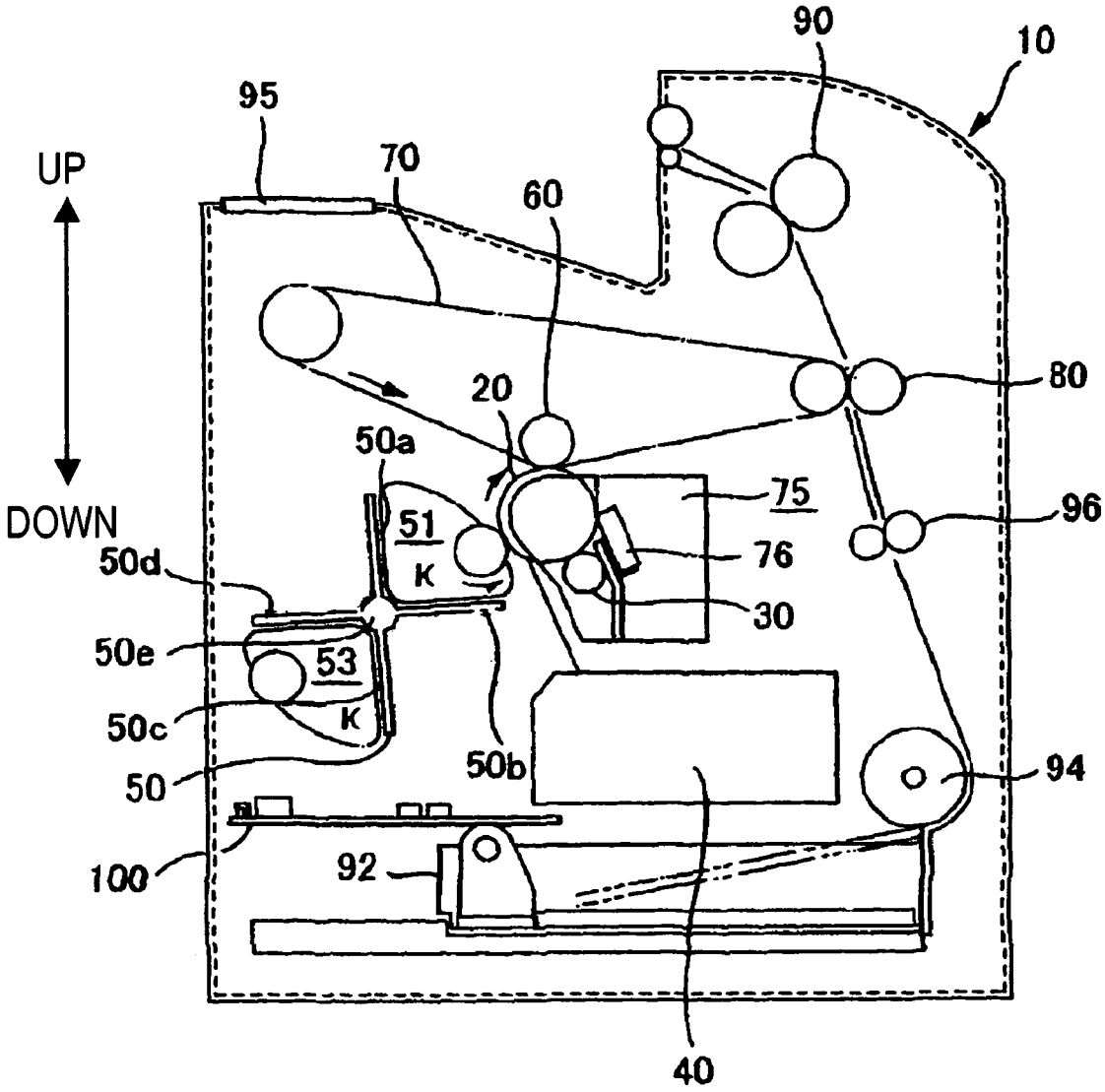
FIG. 3 shows the principal configuration of the image formation device of the embodiment, when in monochrome printing mode.
Figure 4:
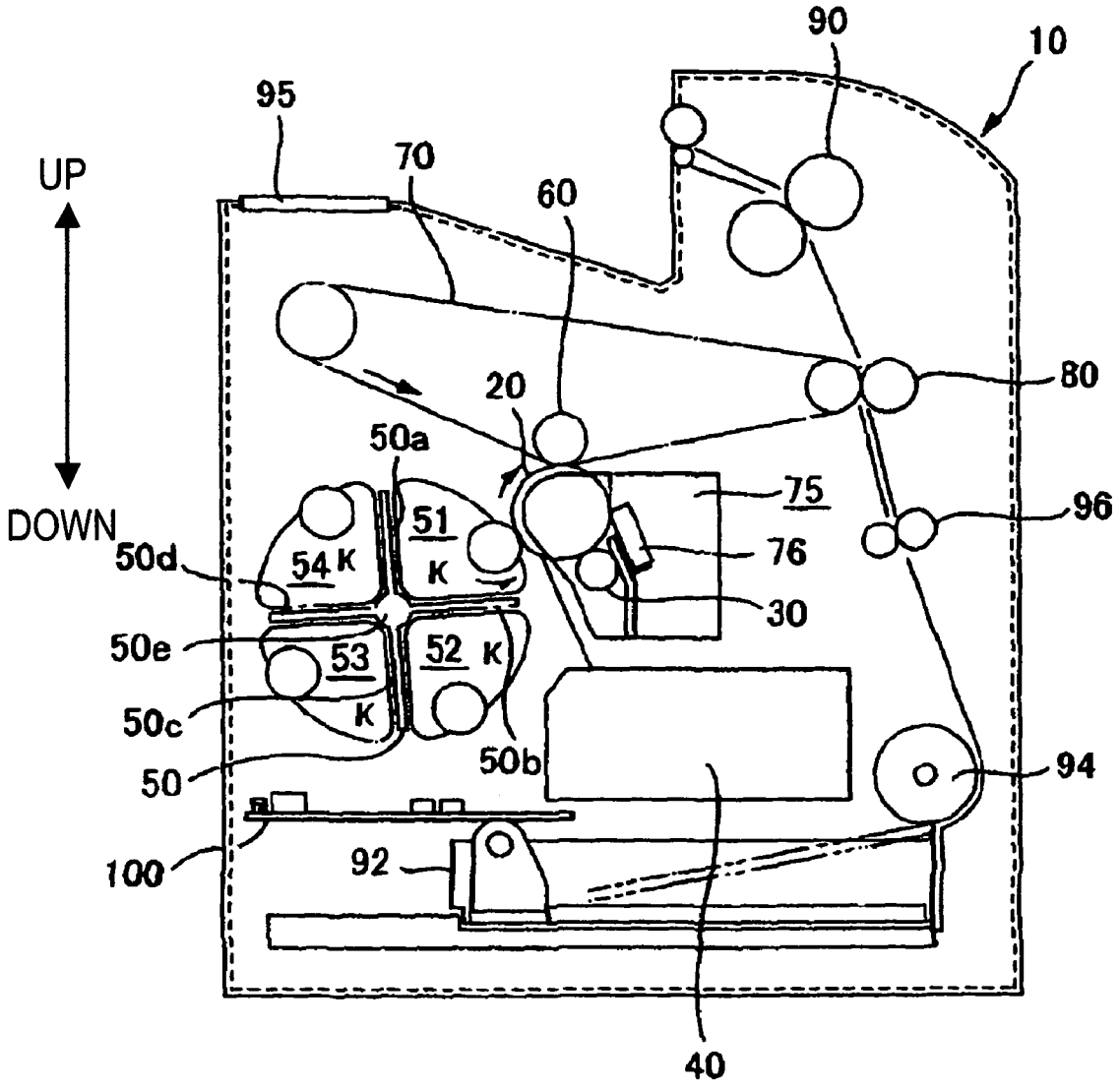
FIG. 4 shows the principal configuration of the image formation device of the embodiment, when in monochrome printing mode.

FIG. 2 through FIG. 4 show the principal configuration of the image formation device of the embodiment; in these drawings, the configuration in black monochrome printing mode (single-color printing mode) is shown. In FIG. 2 through FIG. 4, components which are the same as in FIG. 1 are assigned the same reference numbers. In the example of FIG. 2, a black, development unit 51 is mounted only in the mounting position 50*a* for a black development unit of the development device 50. In this case, black color information is read from the non-volatile memory provided in the development unit 51, described below, and the control unit 100 detects that a black development unit 51 is mounted in the mounting position 50*a* and that development units are not mounted in the other mounting positions, as a consequence of which the monochrome printing mode is detected. Even when a single black development unit is mounted in a mounting position other than the mounting position for black 50*a*, the control unit 100 similarly detects this mounted state, and so detects the black monochrome printing mode. Operation is similar when a development unit in a color other than black is mounted; in this case, the monochrome printing mode in the color of the developing agent of the mounted unit is detected. When a monochrome printing mode is detected, the printer driver of the host computer is notified of the mode information, and as a result the host computer supplies print job data in a language for monochrome printing.

In the example of FIG. 3, black development units 51 and 53 are also mounted in the magenta mounting position 50*c* in addition to the black mounting position 50*a* in the development device 50. By means of the physical engaging means described below, the three color (CMY) development units for color printing can each be mounted only in the respective mounting positions 50*b*, 50*c*, 50*d* determined in advance. On the other hand, a black development unit can be mounted in any of the four mounting positions 50*a* through 50*d*. And as shown in FIG. 3, if black development units 51 and 53 are mounted in the black mounting position 50*a* and in the magenta mounting position 50*c*, the color information in the non-volatile memory provided in the development units is read, the mounted state is detected by the control unit 100, and the black monochrome printing mode is detected.

Because two black development units 51 and 53 are mounted, in monochrome printing, the development unit with the remaining amount of developing agent is given priority to be rotationally controlled to the position of the photosensitive drum 20 to execute the development process. Also, the toner remaining amount information is maintained in the non-volatile memory of the respective development units 51 and 53, the remaining amount information is read, and whether a development unit is mounted, as well as the remaining amount of toner, are displayed on the display panel 95 for each of the mounting positions 50*a* through 50*d*.

Two black development units can be mounted in any two arbitrary positions; in all cases, the printer operates in monochrome printing mode.

In the example of FIG. 4, black development units 51 through 54 are mounted in all the mounting positions of the development device 50. In this case also, the color information in the non-volatile memory of the four development units is read, and the control unit 100 judges the printer to be in monochrome printing mode. The remaining toner amount information in the non-volatile memory of the respective development units is maintained by overwriting and is read, and the display panel 95 displays information indicating that the four development units are mounted, and shows the amounts of toner remaining in each.

Figure 5:
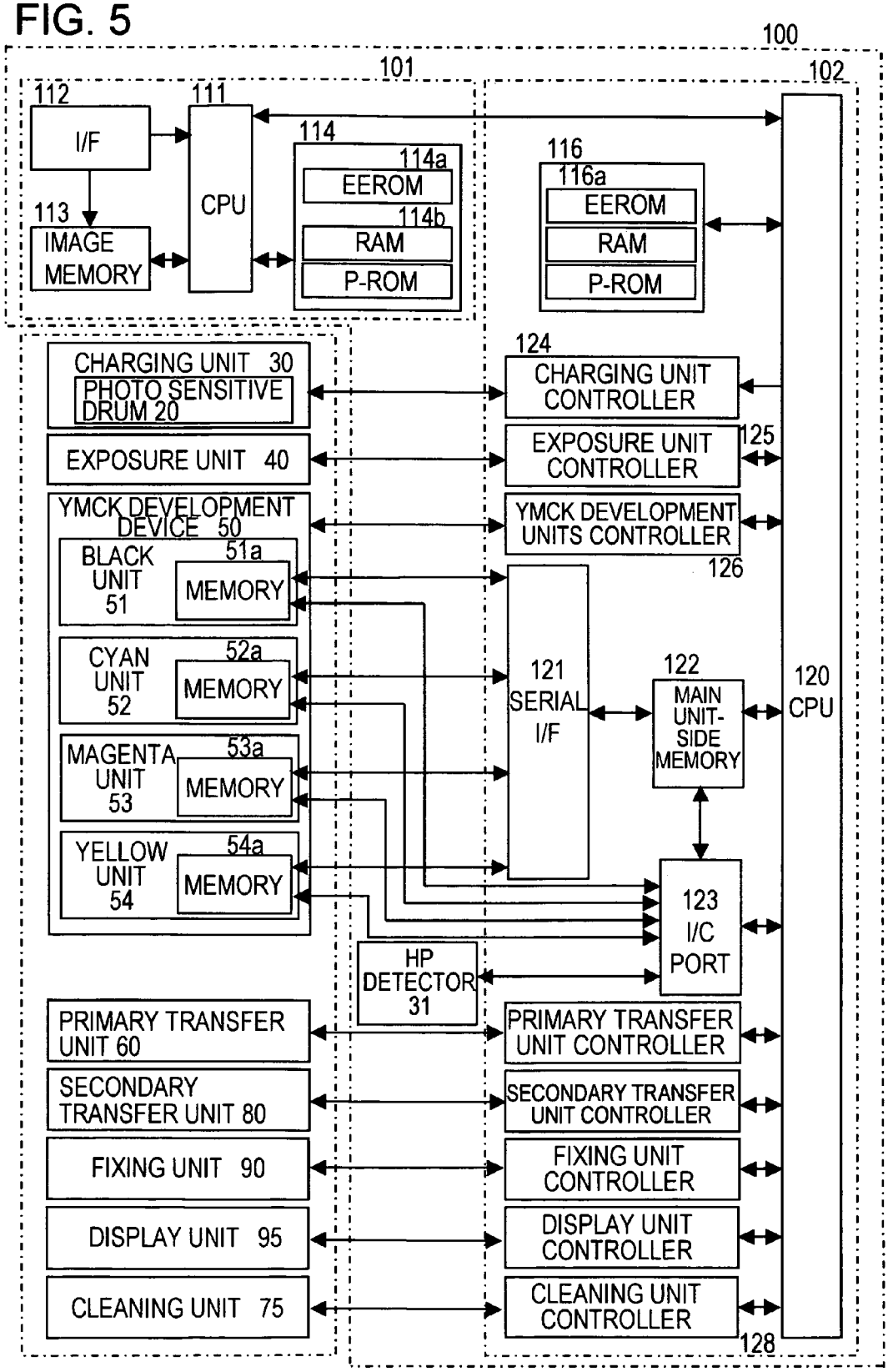
FIG. 5 shows the configuration of the control unit 100 in the embodiment.

FIG. 5 shows the configuration of the control unit 100 in the embodiment. The control unit 100 has a main controller 101, to which is supplied print job data by the host computer, and which performs prescribed image processing and generates control signals as well as image signals. Further the control unit 100 has an engine controller 102, which controls each of the units of the printing engine. The main controller 101 has an interface 112 which receives print job data from the host computer; an image memory 113 which stores image data in the print job data; a CPU 111 which performs halftone processing and other image processing; and a memory unit 114, which has non-volatile memory 114*a* and RAM and program ROM 114*b*.

Mode information, indicating whether the printer is in color printing mode or is in monochrome printing mode, is stored in the non-volatile memory 114*a*. The printing mode is judged by the main controller 101 according to information from the memory of development units mounted in the development device when power is turned on; and the printing mode information of this judgment is written to the non-volatile memory 114*a*.

The engine controller 102 has, in addition to a CPU 120, a memory unit 116; a serial interface 121; main unit-side memory 122; an input/output port 123; driving control circuits 124, 125, 126 which drive the charging unit 30, exposure unit 40, and developing unit 50; and a driving control circuit group 128 which drives the primary transfer unit 60, secondary transfer unit 80, fixing unit 90, display unit 95, and cleaning unit 75. In addition, a detection portion 31 which detects the home position of the development device 50 is provided.

The engine controller 102 is supplied by the main controller 101 with control signals which control the printing process and image signals which control exposure beam irradiation, and executes control of each unit. The development units 51 through 54 mounted in the development device 50 each have respective development unit memory devices 51*a* to 54*a*. These memory device comprise, for example, FeRAM, EEPROM, or other non-volatile memory, and store such information as developing agent color information, remaining developing agent amount information, and development unit IDs. When these memory devices comprise FeRAM, non-contact access is possible via the serial interface 121; when comprising EEPROM, access is possible by physical connection to the serial interface 121. When power is turned on, and when a development unit is replaced or mounted, the engine controller 102 accesses the development unit memory devices 51*a* through 54*a* and reads information indicating whether a development unit is mounted, color information, and similar. In the development process, information on the amount of developing agent remaining is updated in the memory of a development unit for which the development process has ended.

The main unit-side memory 122 comprises for example EEPROM or other non-volatile memory, and stores parameter values for engine control and similar. The non-volatile memory 116*a* within the memory unit 116 stores information as to whether development units are mounted in the four mounting positions of the development device, and the colors of the mounted development units.

Figure 6A:
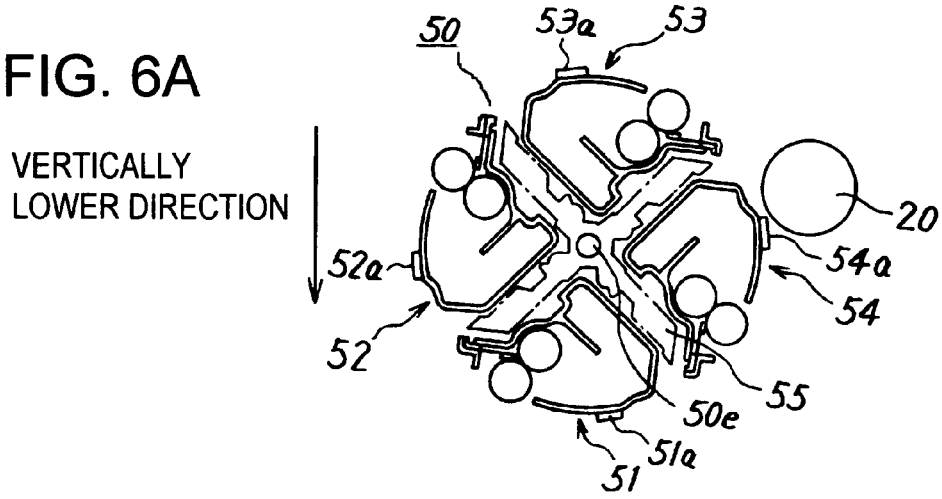
FIGS. 6A-6C show the rotational operation of the development device.
Figure 6B:
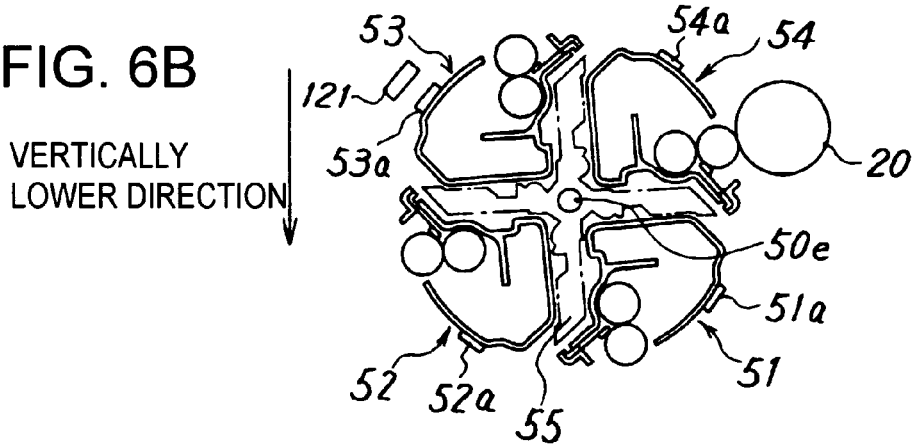
Figure 6C:
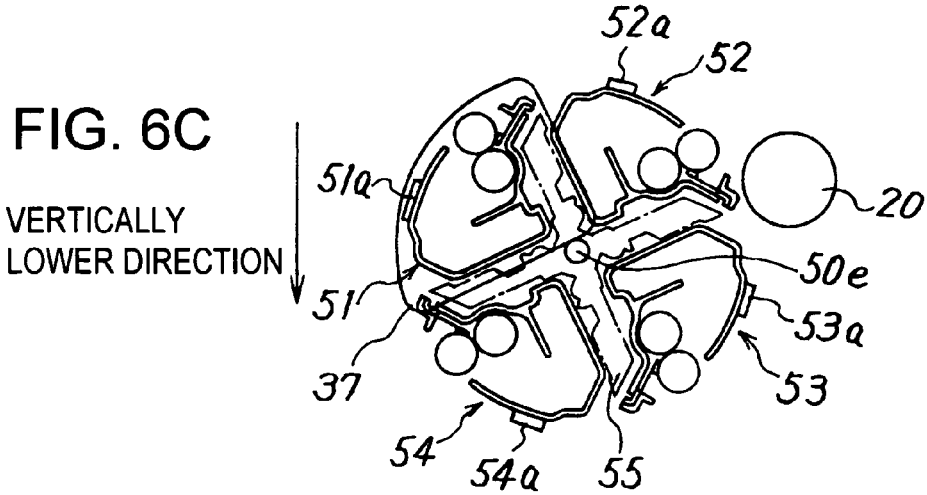
Figure 7A:
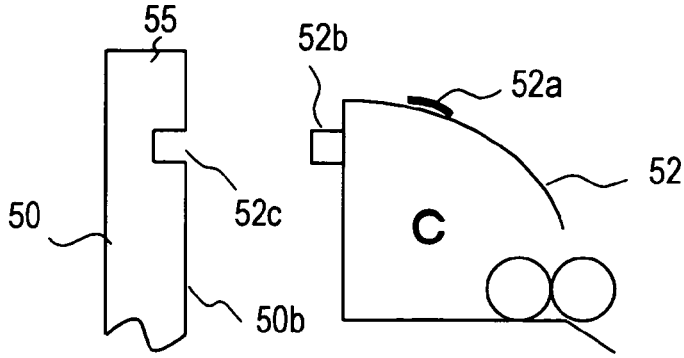
FIGS. 7A-7D show the engaging means of the development device and development units.
Figure 7B:
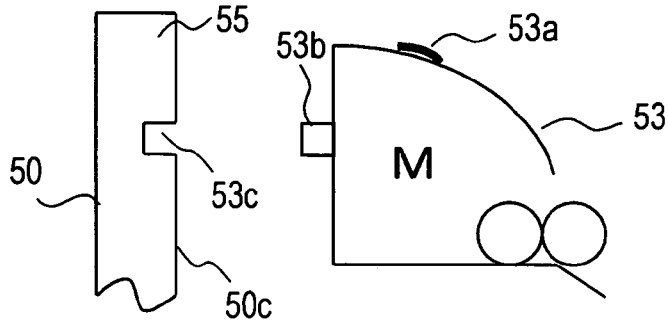
Figure 7C:
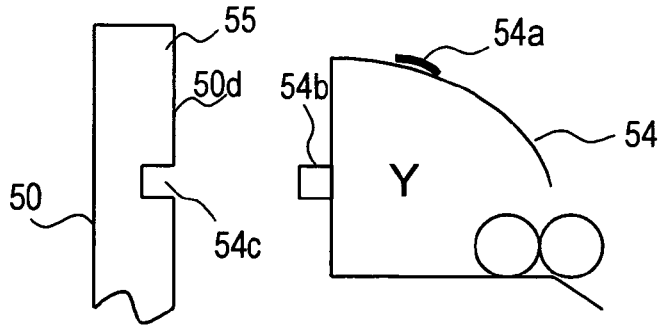
Figure 7D:
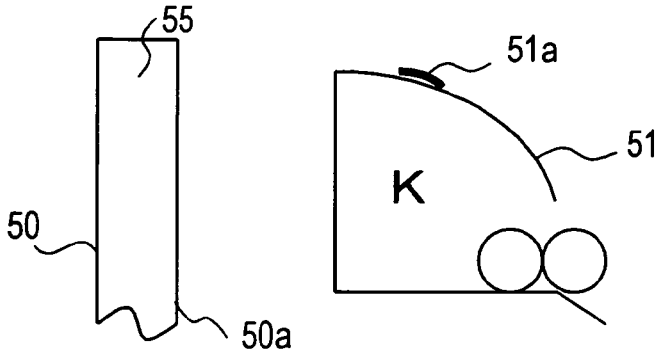

FIG. 6 shows the rotational operation of the development device. In FIG. 6, three positional relationships between the development device 50 with the four development units 51 to 54 mounted and the photosensitive drum 20 are shown. FIG. 6A shows the home position; FIG. 6B shows the development and memory access position; and FIG. 6C shows the development unit detachment position. The development device 50, which is a developing rotary, rotates about the center axis 50*e* due to a pulse motor, not shown; the center shaft 50*e* is fixed to a support frame 55 which holds the development unit.

The home position in FIG. 6A is a position detected by the home position detection portion 31 (FIG. 5), and is the reset position for developing rotary rotation control. In this position, the development unit is not aligned with the attachment/detachment hole 37 (in FIG. 6C), so that even if a development unit replacement panel (not shown) were opened, replacement of the development unit would be prevented.

In the development position in FIG. 6B, the development roller of the development unit 54 is brought into proximity with the photosensitive drum 20, and the developing agent of the development unit 54 is supplied to the photosensitive drum 20. Also, in this position the memory 53*a* of the development unit 53, which has just finished the development process, is accessed in contact-free fashion by the serial interface 121, information in the memory 53*a* is read, and the remaining developing agent amount information is updated. If non-contact access is used, no physical force need be applied to the development device even during the development process, so that the development process is not affected.

The attachment/detachment position in FIG. 6C is a position to which the development device is rotated when the replacement panel of the development unit is opened and a replacement button is pressed; in this position, the development unit 51 can be replaced via the replacement aperture 37. For example, each time the replacement button is pressed, the development device 50 is rotated by 90°, with control executed to rotate successive development units into the attachment/detachment position. Or, when the out-of-toner state is detected and development unit replacement is selected, in response to the replacement button, the development device 50 is rotated to the position of the development unit for which an out-of-toner state has been detected or to a position into which no development unit has been mounted. In place of the above replacement button, four mounting position buttons, corresponding to the four mounting positions, may be provided. In this case, when a mounting position button corresponding to a mounting position for replacement is pressed, the mounting position is rotated to the attachment/detachment position.

FIG. 7 shows the engaging means or element of the development device and development units. FIG. 7A shows the engaging structure between the cyan development unit 52 in the mounting position 50*b* and the support arm 55; the protrusion 52*b* of the development unit 52 and the depression 52*c* of the support frame 55 are formed so as to engage together. FIG. 7B shows the engaging structure between the magenta development unit 53 and the support frame 55 in the mounting position 50*c*; FIG. 7C shows the engaging structure between the yellow development unit 54 and the support frame 55 in the mounting position 50*d*. Similarly in these drawings, depressions 53*c*, 54*c* are provided on the side of the support frame 55 which engage with the protrusions 53*b*, 54*b* on the side of the development unit. FIG. 7D shows the structure of the black development unit 51 and the support frame 55 in the mounting position 50*a* thereof. No protrusion is formed in the black development unit 51, and accompanying this, no depression is formed in the support arm 55. Each development unit is inserted and retracted in the direction perpendicular to the plane of the paper, to be mounted or removed.

As is seen from the engaging structure shown in FIG. 7, protrusions 52*b*, 53*b*, 54*b* are provided at different positions on the CMY development units 52, 53, 54, and depressions 52*c*, 53*c*, 54*c* are provided at corresponding positions of the mounting positions 50*b*, 50*c*, 50*d* at which the former are mounted. By means of these engaging structure, the CMY development units can only be mounted in positions determined in advance. Mounting in positions other than predetermined positions is not possible. Using such physical engaging means in color printing mode ensures that CMYK development units are mounted in order in the predetermined positions, so that color printing is performed at high printing speed and with high image quality. On the other hand, no protrusion is formed on black development units 51, so that in addition to the black mounting position 50*a*, mounting in any of the other mounting positions 50*b*, 50*c*, 50*d* is also possible.

Figure 8:
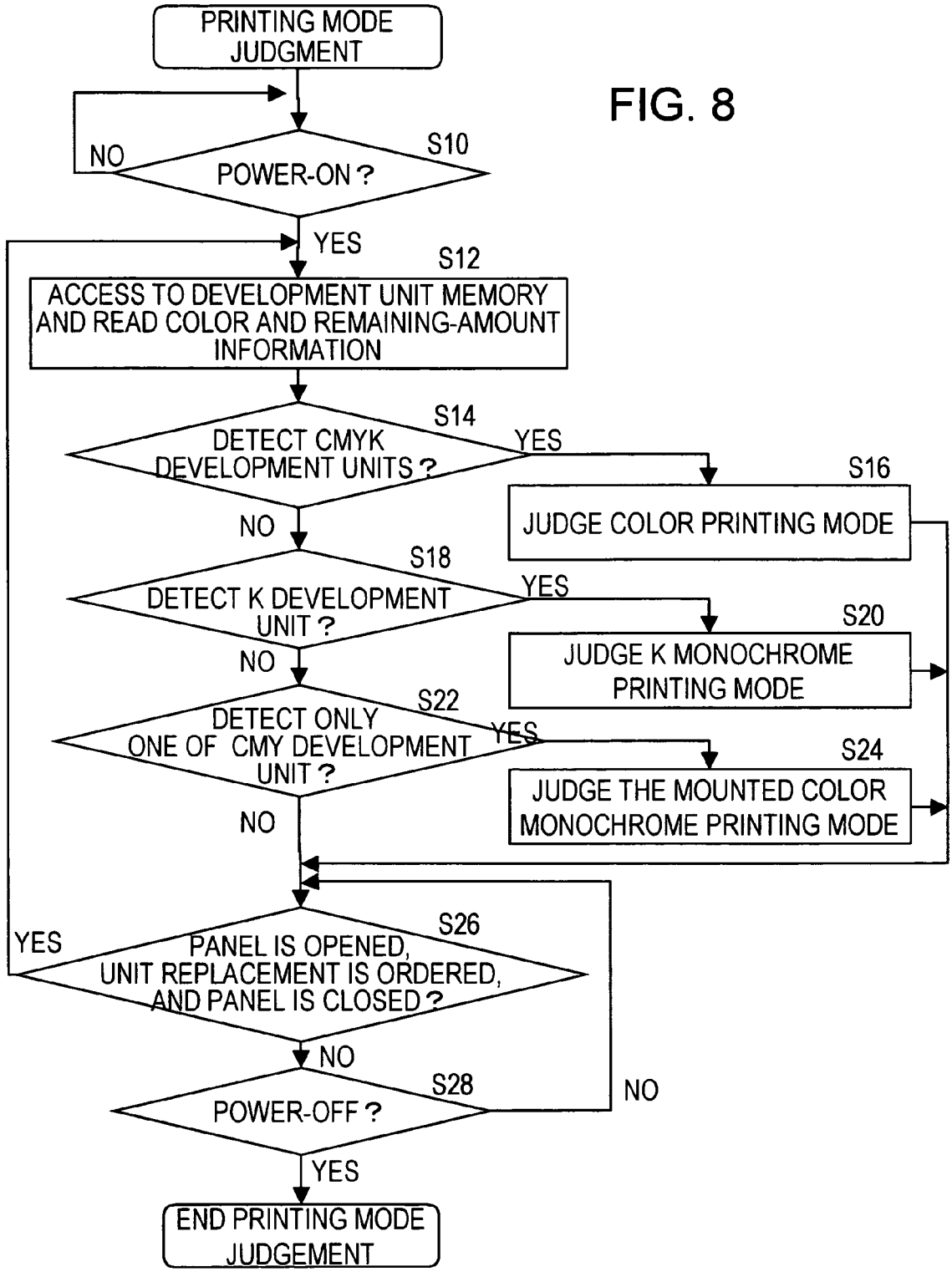
FIG. 8 is a flowchart showing printing mode judgment operation in the embodiment.

FIG. 8 is a flowchart showing printing mode judgment operation in this embodiment. FIG. 9 shows a judgment table for printing mode judgment. When power is turned on (S10), the control unit 100 which is the control means of the printer 10 rotates the development device to the memory access position, accesses the non-volatile memory of development units mounted in the development device, and reads the developing agent color information and remaining-amount information (S12). When it is recognized that black (K), magenta (M), cyan (C), and yellow (Y) development units are mounted in the four mounting positions (the black, magenta, cyan, and yellow mounting positions) of the development device (S14), the main controller 101 of the control unit 100 judges the printer to be in color printing mode, and writes this data to the non-volatile memory 114*a* (S16). When a black development unit is recognized as being mounted in any of the four mounting positions (S18), the main controller 101 of the control unit judges the printer to be in black monochrome printing mode, and writes this data to the non-volatile memory 114*a* (S20).

Judgments up to this point have been made according to the judgment table of FIG. 9. That is, since only development units of the predetermined colors CMY can be mounted in the four mounting positions, therefore when the printer is judged to be in color printing mode, the CMYK development units are mounted in the predetermined order of rotation. Hence in the four development processes of the color printing mode, the four development units of the development device 50 need only rotated and brought into proximity with the photosensitive drum 20 in order, therefore a high-speed printing with high image quality is possible. If the CMYK development units could be mounted in arbitrary mounting positions, in order to perform development in CMYK order to achieve high image quality, the rotation direction of the development device would have to be changed while bringing the development units into proximity with the photosensitive drum, resulting in complex rotation control and reducing the development speed.

On the other hand, the printer is judged to be in black monochrome printing mode regardless of the mounting position of the black development unit. That is, there are no constraints on the mounting position of the black development unit, and so the user is allowed to mount an arbitrary number of black development units in arbitrary positions, for increased convenience.

When it is recognized that a development unit of only one of the CMY colors is mounted (S22), the printer is judged to be in monochrome printing mode in the color of the developing agent of the mounted development unit (S24). In this case, because the CMY development units can only be mounted in predetermined mounting positions, only a single development unit can be mounted.

When, in response to an out-of-toner display or similar, a user opens a development unit replacement panel and presses a development unit replacement button to specify unit replacement, and then closes the replacement panel (S26) after development unit replacement, the control unit 100 executes the judgment operations of the above steps S12 to S24. Also, when power is turned off, judgment operations end (S28).

Figure 10:
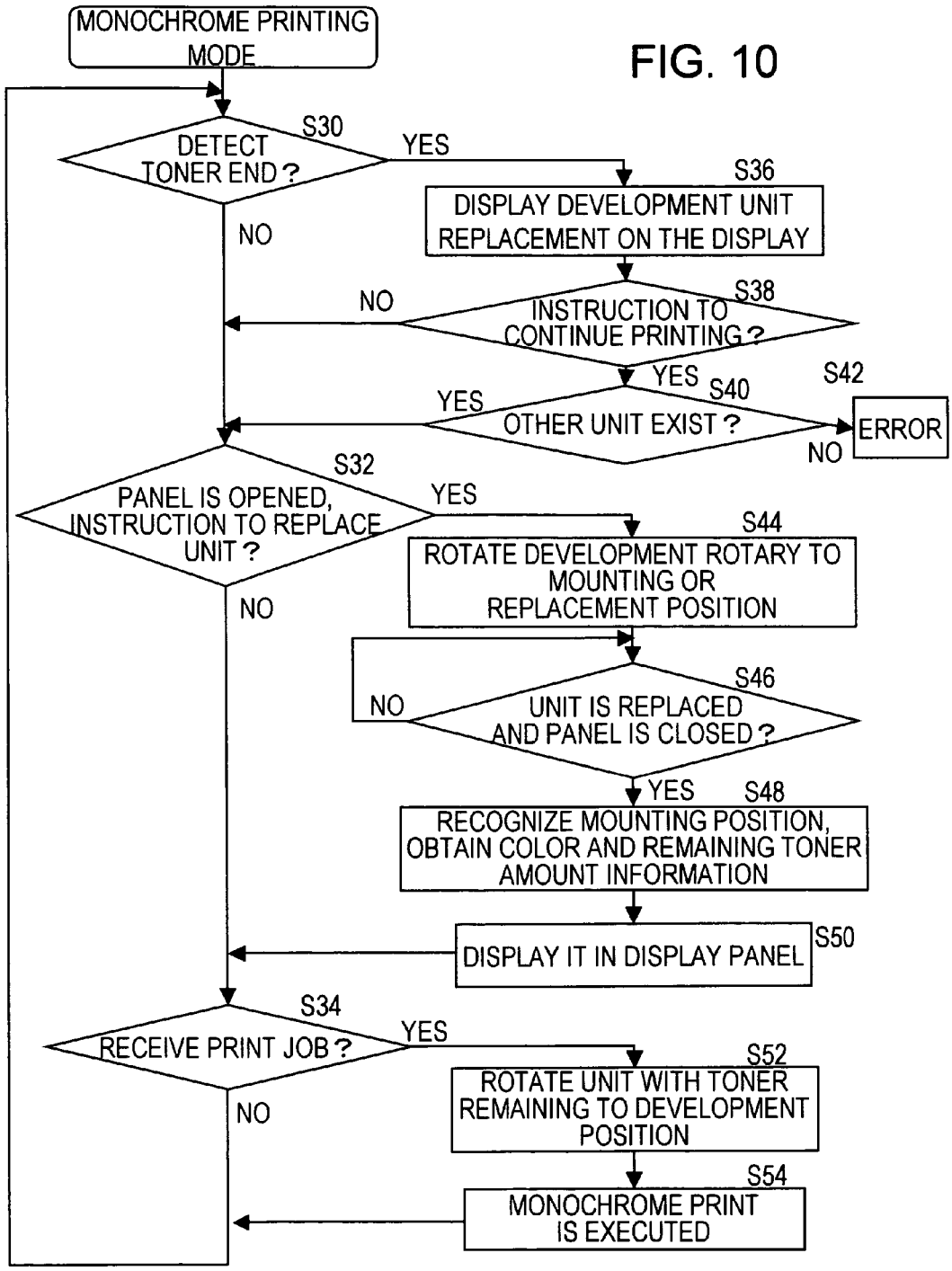
FIG. 10 is a flowchart showing operation in black monochrome printing mode.

FIG. 10 is a flowchart showing operation in black monochrome printing mode. FIG. 11 and FIG. 12 show examples of the mounted state of development units and of display panel displays in black monochrome printing mode. In black monochrome printing mode, an arbitrary number of black development units are allowed to be mounted in arbitrary positions among the four mounting positions of the development device, to simplify the mounting or replacement operation of development units when in an out-of-toner state or similar; the mounted positions of development units and the amount of developing agent remaining in each are displayed on the display panel 95.

As explained in the printing mode judgment operation of FIG. 8, when power is turned on, the non-volatile memory of the mounted development units is accessed, and the color information and remaining amount information for each are read and are displayed on the display panel 95. When the printer is judged to be in black monochrome printing mode, as in FIG. 11 and FIG. 12, the display panel 95 displays a display 200 indicating monochrome printing mode, and a display 201 indicating whether development units are mounted in each of the mounting positions 202 and the remaining amount information. For example, when as shown FIG. 11A a black development unit K is mounted in the cyan mounting position 50*c*, and if the remaining amount in the black development unit is 100%, then the display panel displays an all-black container symbol in the cyan mounting position (C in 202), as shown in 95A-1. If the toner amount remaining in the black development unit is zero, then the display panel displays an all-white container symbol 201C at the cyan mounting position, as shown in 95A-2. In this case, the display indicates that a black development unit is mounted in the cyan mounting position, but that the remaining amount is zero.

Figure 11A:
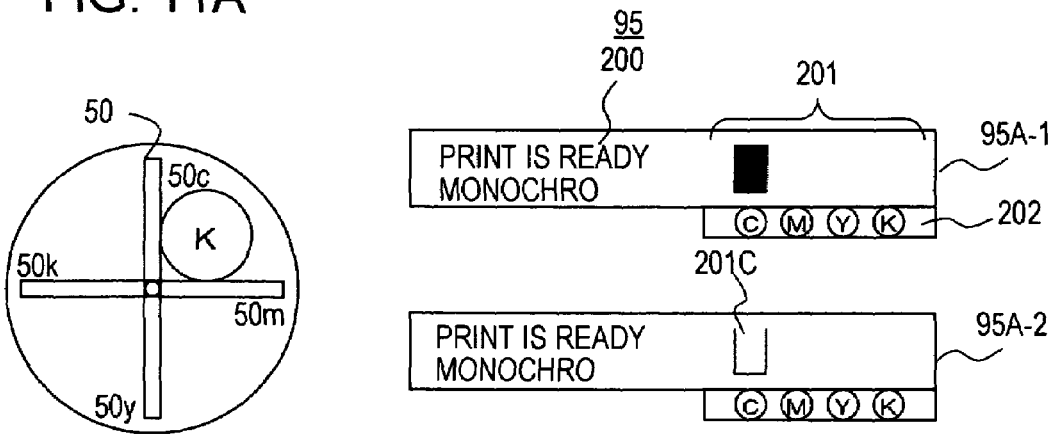
FIGS. 11A-11D show examples of the mounted state of development units and of display panel displays in black monochrome printing mode.
Figure 11B:
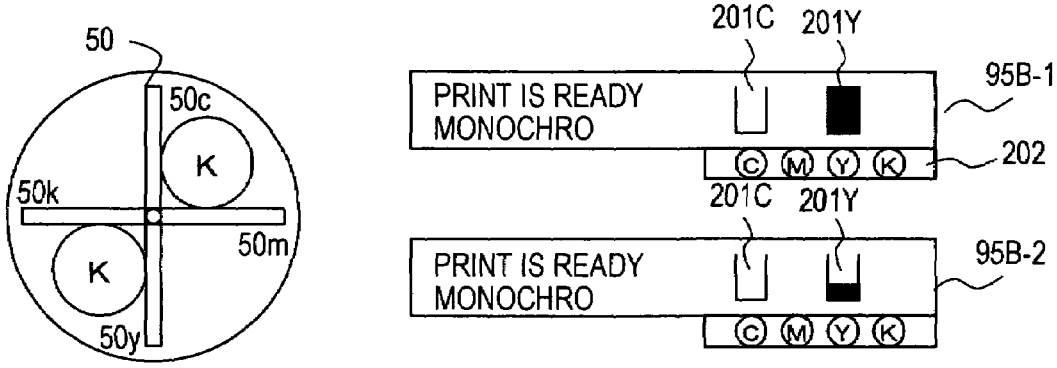

As shown in FIG. 11B, when an empty black development unit is mounted in the cyan mounting position 50*c* and a black development unit with remaining amount 100% is mounted in the yellow mounting position 50*y*, as shown in 95B-1, an empty container symbol 201C is displayed in the cyan mounting position (C in 202), and an all-black container symbol 201Y is displayed in the yellow mounting position (Y in 202). Subsequently, as the amount of developing agent remaining in the black development unit in the yellow mounting position decreases, a partially-black container symbol 201Y is displayed in the yellow mounting position (Y in 202), as shown in 95B-2.

In this way, the display panel 95 displays a display 200 indicating the black monochrome printing mode, and a display 201 indicating which development units are mounted in which mounting positions, with the respective remaining toner amounts. Hence in black monochrome printing mode, management of development units, including mounting and replacement, can be performed easily.

Returning to FIG. 10, when in black monochrome printing mode the amount of developing agent remaining in the mounted development unit is detected to be 0% (S30), the display panel 95 displays an indication to replace the development unit due to the out-of-toner state of the development unit (S36). In black monochrome printing mode, mounting of a plurality of black development units is allowed, and so a user can view the amounts-remaining display on the display panel 95 for development units mounted, and when for example a development unit with toner remaining is mounted, can issue an instruction to continue printing by pressing a button on the operation panel or by a command from the print driver of the host computer. When an instruction to continue printing is input (S38) without replacing the development unit, if there exist other development units with toner remaining, an error does not occur even when the development unit is not replaced; but if there exist no other development units with toner remaining, an error occurs (S42).

When the user opens the development unit replacement panel and presses the unit replacement button (S32), the engine controller 102 of the control unit 100 executes control to rotate the development device rotary until the mounting position for mounting or the mounting position for replacement matches the position of the replacement aperture (not shown) (S44). This rotation control is performed automatically such that the position with highest priority is caused to match the replacement aperture, with priority given first to unmounted positions, then to the mounting position of a development unit with the amount of toner remaining being zero, and then to the mounting position of a development unit with a small amount of toner remaining. Judgment of the position to which the development device should be rotated is performed by the control unit 100. Or, the user can manually specify the position for replacement by using four development unit buttons.

Hence when a development unit is mounted or replaced, and the replacement panel is closed (S46), the control unit 100 accesses the memory of the development unit, recognizes the mounting position, and acquires the color information and remaining-amount information (S48). And as shown in FIG. 11 and FIG. 12, the control unit 100 displays the mounting position and remaining-amount information on the display panel 95 (S50).

When a print job is received from the host computer (S34), in the control unit 100, the main controller 101 performs any necessary halftone processing or other image processing, and then outputs control signals and image data to engine controller 102; the engine controller 102 rotates a development unit with toner remaining to the position of the photosensitive drum (S52), and uses this to execute monochrome printing control (S54).

Next, the black development unit mounted state and the display state of the display panel when using the printer in monochrome printing mode are explained, referring to FIG. 11 and FIG. 12. On the left sides of FIG. 11 and FIG. 12 are shown examples in which black development units K are mounted in the development device 50; on the right are shown examples of displays on the display panel 95.

When use of the printer in monochrome printing mode is begun, if for example one black development unit is mounted in an arbitrary mounting position, as in FIG. 11A, printing is possible. In the example of FIG. 11A, a black development unit is mounted in the cyan mounting position 50*c*, and so the "monochr" symbol 200 indicating black monochrome printing mode, and a 100% black container symbol 201 at the cyan position (C of 202), are displayed (95A-1). Thereafter, when the development unit is used to repeat monochrome printing, and the toner amount remaining in due course decreases, so that a container symbol 201C indicating that a development unit is mounted in the cyan mounting position 50*c*, but the amount remaining is zero is displayed (95A-2). The mounting position display 202 need not necessarily be displayed within the display panel 95, but may for example be displayed on a seal affixed adjacent to the display panel.

At this time, the control unit 100 reads the remaining-amount information and recognizes that the amount of toner remaining has become zero, and so displays a message (not shown) indicating replacement of the development unit due to the out-of-toner state. The user references the display on the display panel, and can learn which development unit has zero remaining developing agent, at which mounting positions mounting is possible without replacing a development unit, and at which mounting positions development unit replacement is possible.

The user then opens the replacement panel, uses a button to manually specify the mounting position or replacement position for a new development unit, and causes the control unit 100 to rotate the mounting position of the development device to the replacement aperture. Or, the user opens the replacement panel, presses a development unit replacement button, and automatically causes rotation to the position for mounting. In this automated rotation control, the mounting position is selected with priority given first to unmounted positions, then to mounting positions of development units with zero remaining toner, and then to the mounting position of the development unit with the least remaining toner. Control is executed to rotate the selected position to the position of the replacement aperture.

In the example of FIG. 11B, a new development unit is mounted in the yellow position. Consequently a 100% remaining symbol 201Y is displayed at the yellow position (Y of 202) on the display panel 95 (95B-1). When in due course the amount of toner remaining in this development unit decreases, the black display area of the container symbol 201Y is made smaller (95B-2).

Figure 11C:
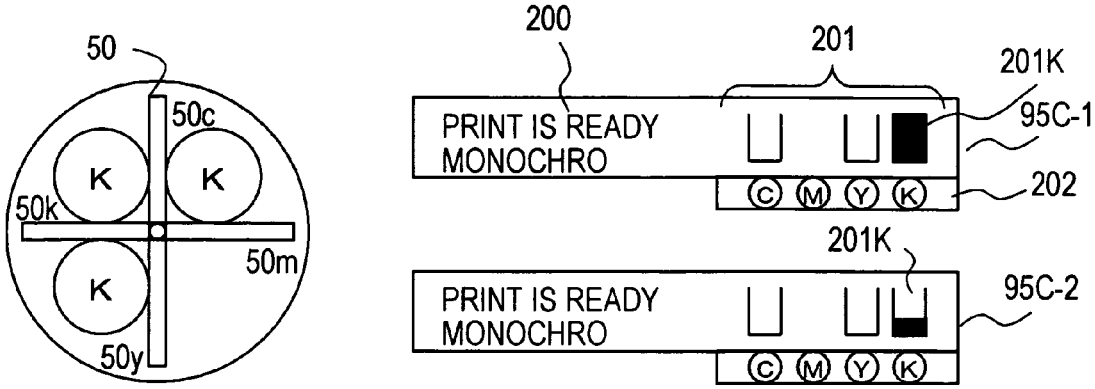

In the example of FIG. 11C, a new development unit is mounted in the black position, and a container symbol 201K is displayed on the display panel 95 indicating a remaining amount of 100% at the black position (K of 202) (95C-1). When in due course the remaining amount in this development unit decreases, the black display area of the container symbol 201K becomes smaller (95C-2). In this state, the display panel shows that the remaining amounts of the development units in the cyan position and in the yellow position are zero, and that the amount remaining in the development unit in the black position is low.

Figure 11D:
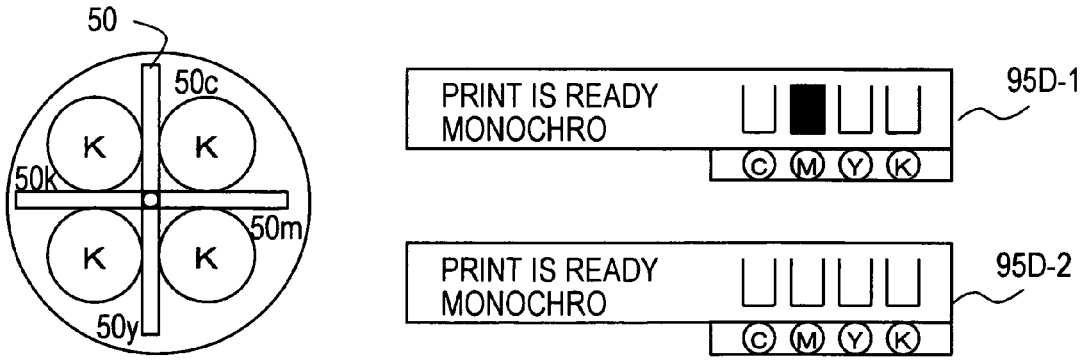
Figure 12E:
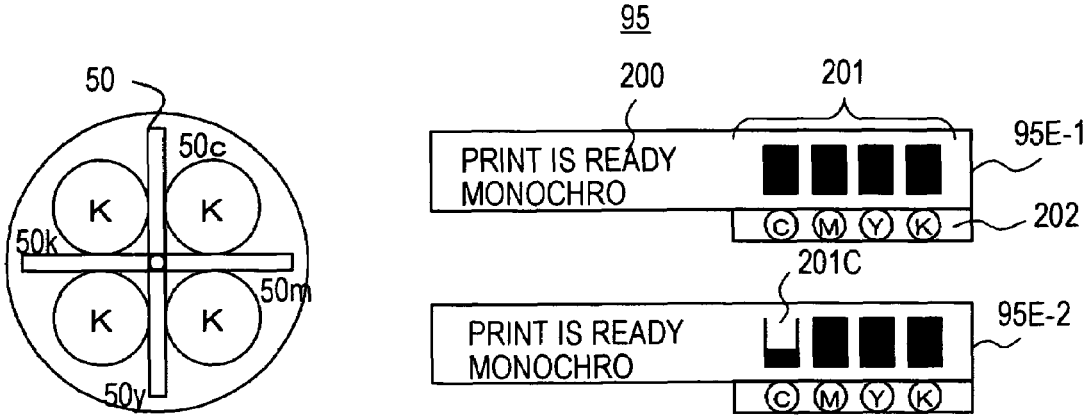
FIGS. 12E-12H show examples of the mounted state of development units and of display panel displays in black monochrome printing mode; and, FIG. 13 shows an example of display of development unit mounted positions and toner amounts remaining, by means of the printer driver of the host computer.
Figure 12F:
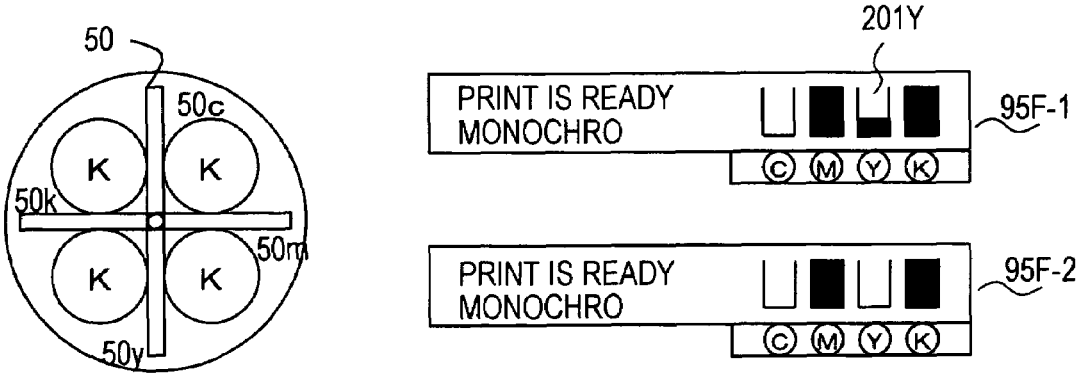
Figure 12G:
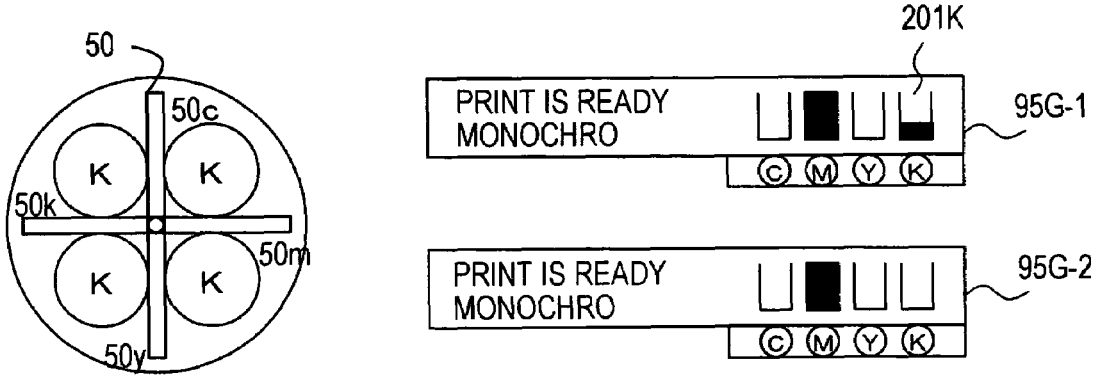
Figure 12H:
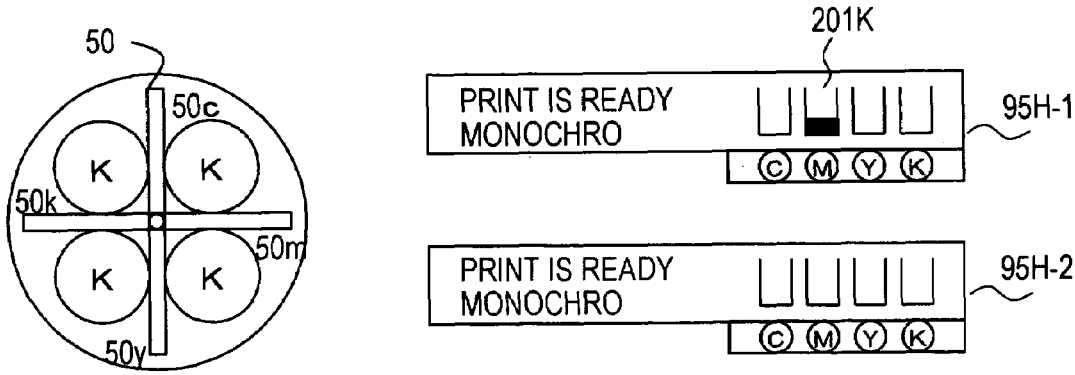

In the example of FIG. 11D, a new development unit is mounted in the magenta position, and the display panel shows that, in due course, the toner amount remaining is decreased.

FIG. 12 shows examples in which black development units are mounted in all four mounting positions. In FIG. 12E through FIG. 12H, the display state of the display panel 95 is shown when the toner amount remaining is zero in the development unit mounted in, in order, the cyan position, the yellow position, the black position, and the magenta position. The display panel 95 shows that development units are mounted in the four positions, and shows the remaining toner amounts in each. Hence in processing to replace a development unit accompanying an out-of-toner state, the user can easily judge when to replace the development units at which positions.

Figure 13:
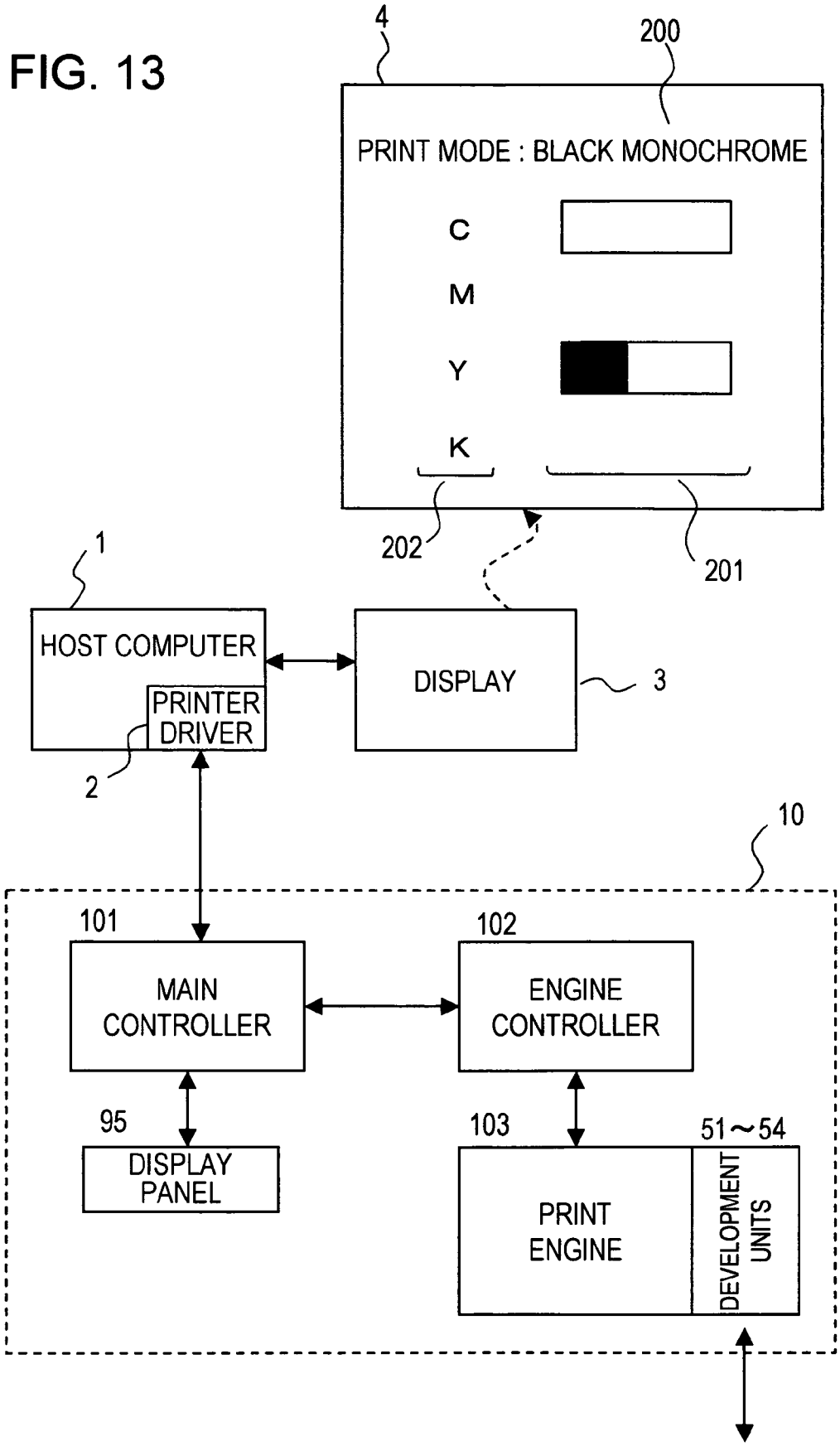

FIG. 13 shows an example of display of development unit mounted positions and toner amounts remaining, by means of the printer driver of the host computer. The printer 10 is connected to the host computer 1 either directly or via a network; by means of the printer driver 2 installed in the host computer 1, an image 4 showing the mounting positions and toner remaining amounts of development units can be displayed on the display 3.

When power is turned on, the main controller 101 acquires, via the engine controller 102, mounting position and color information as well as toner remaining-amount information for the development units 51 to 54 in the engine 103, and notifies the printer driver 2. Thereafter, when the mounted state of a development unit changes, or when the toner remaining-amount information is updated, the printer driver is notified of this information. As shown in the image 4 in the FIG. 13, the fact that the printing mode is the black monochrome printing mode, whether development units are mounted in the respective CMYK mounting positions, and the amounts of toner remaining can be displayed on the monitor screen 3 of the host computer 1 for the user to view. The information displayed is the same as that on the display panel 95, and is as explained in FIG. 11 and FIG. 12.

In the above embodiment, a monochrome printing mode for printing in black has been explained; however, these aspects can be applied to monochrome (single-color) printing modes in any of the CMY colors other than black as well.

What is claimed is:

1. An image formation device, comprising:

an image carrier in which is formed a latent image;

a development device in which a plurality of development units housing a developing agent can be detachably mounted; and a control unit that controls a print operation, wherein:

development units of a plurality of colors used to form color images, excluding a development unit of black color to form monochrome images, are mountable only in respectively reserved mounting positions of said development device, said development unit of black color is mountable in any mounting position among said plurality of mounting positions, when the development units of the plurality of colors, used to form color images, are mounted in the respectively reserved mounting positions of said development device, said control unit controls the print operation to operate in a color printing mode and controls a development process by using the development units of the plurality colors in an order of the reserved mounting positions;

when the development unit of black color is mounted in any of the plurality of mounting positions, the control unit controls the print operation to operate in a monochrome printing mode.

2. The image formation device according to claim 1, wherein the development units of said plurality of colors, excluding the development unit of black color, are mounted in said respectively reserved mounting positions of said development device via respectively different engaging structure, and said development unit of black color has engaging structure enabling mounting in the any of said plurality of mounting positions.

3. The image formation device according to either claim 1 or claim 2, wherein, even when a plurality of said development units of black color are mounted in said development device, operation is in said monochrome printing mode.

4. The image formation device according to claim 1, wherein each of said development units has a storage unit which stores color information and remaining-amount information for the developing agent housed therein, and said control unit judges whether the print operation is in said color printing mode or monochrome printing mode, according to the color information in said storage unit of development units mounted in said development device.

5. The image formation device according to claim 4, wherein when said control unit judges the print operation to be in said monochrome printing mode, the control unit uses a development unit of black color with developing agent remaining among said mounted development units to develop the latent image in said image carrier.

6. The image formation device according to claim 4, further having a display unit which displays, in association with said plurality of mounting positions, whether said development unit is mounted, and information on the amount of developing agent remaining in a mounted development unit; and wherein said control unit causes said display unit to display information on whether a development unit is mounted at each of said plurality of mounting positions and remaining-amount information for the developing agent of the mounted development unit.

7. The image formation device according to claim 6, wherein said control unit causes said display unit to display information for distinguishing said color printing mode and monochrome printing mode.

8. The image formation device according to claim 4, wherein said control unit appropriately outputs, to a host computer connected to the image formation device, data indicating information on whether said development unit is mounted, color information and remaining-amount information of developing agent in the mounted development unit, in association with said plurality of mounting positions.

9. The image formation device according to claim 8, wherein said control unit outputs, to said host computer, data causing a display to distinguish between said color printing mode and monochrome printing mode.

10. An image formation device, comprising:

an image carrier in which is formed a latent image;

a development device in which a plurality of development units housing a developing agent can be detachably mounted; and a control unit that controls a print operation, wherein:

development units of a plurality of colors used to form color images, excluding a development unit of black color to form monochrome images, are mountable only in respectively reserved mounting positions of said development device, said development unit of black color is mountable in any mounting position among said plurality of mounting positions, when the development units of the plurality of colors, used to form color images, are mounted in the respectively reserved mounting positions of said development device, said control unit controls the print operation to operate a color printing mode and controls a development process by using the development units of the plurality colors in an order of the reserved mounting positions;

when a the development unit of black color is mounted in any of the plurality of mounting positions, said control unit controls the print operation to in a monochrome printing mode;

each of said development units has a storage unit which stores color information and remaining-amount information for the developing agent housed therein; and, said image formation device further has a display unit which displays, in association with said plurality of mounting positions, information as to whether said development unit is mounted and remaining-amount information for the developing agent of the mounted development unit, according to the color information and remaining-amount information stored in said storage unit of development units mounted in said development device.

11. An image formation device, comprising:

an image carrier in which is formed a latent image;

a development device a plurality of development units housing a developing agent can be detachably mounted; and a control unit that controls a print operation, wherein:

development units of plurality of colors used to form color images, excluding a development unit of black color to form monochrome images, are mountable only in respectively reserved mounting positions of said development device, said development unit of black color is mountable in any mounting position among said plurality of mounting positions, when the development units of the plurality of colors, used to form color image, are mounted in the respectively reserved mounting positions of said development device, said control unit controls the print operation to be operated in a color printing mode and controls a development process by using the development units of the plurality colors in an order of the reserved mounting positions;

when the development unit of black color is mounted in any of the plurality of mounting positions, said control unit controls the print operation to be operated in a monochrome printing mode;

each of said development units has a storage unit which stores color information and remaining-amount information for the developing agent housed therein; and, said control unit outputs to a host computer connected to the image formation device, and, in association with said plurality of mounting positions, display data to display information as to whether said development unit is mounted and remaining-amount information for the developing agent of the mounted development unit, according to the color information and remaining-amount information stored in said storage unit of development units mounted in said development device.

* * * * *